US010144605B2

(12) United States Patent
Wakakusa et al.

(10) Patent No.: US 10,144,605 B2
(45) Date of Patent: Dec. 4, 2018

(54) IMAGE RECORDING APPARATUS

(71) Applicant: BROTHER KOGYO KABUSHIKI KAISHA, Nagoya-shi, Aichi-ken (JP)

(72) Inventors: Keisuke Wakakusa, Nagoya (JP); Iwane Sano, Obu (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/656,035

(22) Filed: Mar. 12, 2015

(65) Prior Publication Data

US 2015/0259166 A1 Sep. 17, 2015

(30) Foreign Application Priority Data

Mar. 14, 2014 (JP) ..... 2014-052692

(51) Int. Cl.
*B65H 5/26* (2006.01)
*B65H 5/36* (2006.01)

(52) U.S. Cl.
CPC ..... *B65H 5/26* (2013.01); *B65H 5/36* (2013.01); *B65H 2404/6111* (2013.01);
(Continued)

(58) Field of Classification Search
CPC ... B65H 3/66; B65H 5/26; B65H 5/36; B65H 5/38; B65H 2404/56; B65H 2404/61;
(Continued)

(56) References Cited

U.S. PATENT DOCUMENTS 5,772,343 A * 6/1998 Beretta ..... B41J 3/60 101/234
6,814,436 B2 * 11/2004 Anami ..... B41J 13/0063 347/101

(Continued)

FOREIGN PATENT DOCUMENTS

CN 101898699 A 12/2010
JP 2-75564 A 3/1990

(Continued)

OTHER PUBLICATIONS

Notification of Reason for Refusal issued in related Japanese Patent Application No. 2014-052692, dated Nov. 29, 2016.

(Continued)

*Primary Examiner* — Ernesto A Suarez
(74) *Attorney, Agent, or Firm* — Merchant & Gould P.C.

(57) ABSTRACT

An image recording apparatus including: a housing; first through third conveyance paths, the second and third paths merging with the first conveyance path at a joining position; and a first guide member disposed at the joining position, wherein (a) the first guide member is configured to be kept, in a normal state, at a first position at which the first guide member closes at least part of the first conveyance path and opens the second and third conveyance paths to the first conveyance path, at the joining position and (b) the first guide member is configured to be moved, by contacting a sheet conveyed through the first conveyance path, to a second position at which the first guide member opens the first conveyance path and closes at least part of the second conveyance path and at least part of the third conveyance path with respect to the first conveyance path.

2 Claims, 8 Drawing Sheets

(52) U.S. Cl.
CPC ..... *B65H 2404/7414* (2013.01); *B65H 2405/332* (2013.01); *B65H 2407/21* (2013.01); *B65H 2801/12* (2013.01)

(58) Field of Classification Search
CPC ..... B65H 2404/611; B65H 2401/6111; B65H 2404/6112; B65H 2404/612; B65H 2404/63; B65H 2404/74; B65H 2404/741; B65H 2404/7412; B65H 2404/7414; B65H 2404/742; B65H 2404/743; B65H 2404/7431; B41J 11/0045; B41J 11/50; B41J 11/54; B41J 13/0063; B41J 13/009; B41J 13/10; B41J 13/14; B41J 13/16
See application file for complete search history.

(56) References Cited

U.S. PATENT DOCUMENTS 7,079,805 B2 * 7/2006 Suzuki ..... B41J 3/60 399/401
8,348,261 B2 * 1/2013 Moriyama ..... B65H 3/44 271/186
8,353,512 B2 * 1/2013 Masuda ..... B65H 5/26 271/186
8,442,421 B2 * 5/2013 Ichiki ..... B65H 29/58 399/21
8,590,885 B2 * 11/2013 Seki ..... B65H 3/44 271/10.09
8,770,572 B2 * 7/2014 Uchino ..... B65H 5/062 271/9.09
2007/0292189 A1 * 12/2007 Kim ..... B65H 5/062 400/642
2010/0301549 A1 12/2010 Moriyama

FOREIGN PATENT DOCUMENTS

JP 4-66427 A 3/1992
JP 20050144931 A 6/2005
JP 2010-274580 A 12/2010

OTHER PUBLICATIONS

Notification of First Office Action issued in corresponding Chinese Patent Application No. 201510108684.1, dated Feb. 11, 2018.

* cited by examiner

IMAGE RECORDING APPARATUS

CROSS REFERENCE TO RELATED APPLICATION

The present application claims priority from Japanese Patent Application No. 2014-052692, which was filed on Mar. 14, 2014, the disclosure of which is herein incorporated by reference in its entirety.

BACKGROUND OF THE INVENTION

1. Field of the Invention

The present invention relates to an image recording apparatus capable of conveying a sheet and a conveyed medium having a larger thickness than a sheet.

2. Description of the Related Art

Most of image recording apparatus such as printers are capable of recording an image not only on a sheet such as a recording sheet, but also on a recording medium having a larger thickness than a sheet and on a CD and a DVD supported and conveyed by a media tray (hereinafter collectively referred to as "conveyed medium" where appropriate). The conveyed medium is inserted through an inlet formed in a front surface or a rear surface of the image recording apparatus and is conveyed through a main conveyance path formed in the apparatus.

Some of the image recording apparatus have a rear tray provided on a rear surface of the apparatus. A sheet supported by the rear tray is supplied into the apparatus through a rear-surface-side conveyance path. The rear-surface-side conveyance path merges with a main conveyance path from an upper side of the main conveyance path.

In the structure wherein the main conveyance path and the rear-surface-side conveyance path merge with each other as indicated above, there is a possibility that a conveyed medium or a sheet is erroneously conveyed through an unintended conveyance path different from a conveyance path through which the conveyed medium or the sheet should be actually conveyed. To prevent such erroneous conveyance, there has been disclosed a recording apparatus having a guide member. The guide member closes part of the main conveyance path at a predetermined position for enabling a sheet that is being conveyed through the rear-surface-side conveyance path to be smoothly introduced into the main conveyance path when a tray guide configured to support a conveyed medium inserted into the apparatus is located at a retracted position. In conjunction with a movement of the tray guide from the retracted position to a supportable position at which the tray guide can support the conveyed medium, the guide member moves from the predetermined position at which the guide member closes part of the main conveyance path to a position at which the main conveyance path is open.

SUMMARY OF THE INVENTION

The apparatus constructed as described above, however, does not take account of a structure in which three conveyance paths merge with one another, and there is a risk that the guide member described above cannot ensure stable conveyance of the sheet when the guide member is used in the above structure in which the three conveyance paths merge with one another. For moving the guide member, the apparatus constructed as described above inevitably needs a mechanism that permits the guide member and the tray guide to move in conjunction with each other, undesirably resulting in an increased size of the apparatus.

The present invention has been developed to provide an image recording apparatus in which a guide member is movable independently of other members and which can convey a sheet with high stability in a structure in which three conveyance paths merge with one another.

The present invention provides an image recording apparatus comprising: a housing; a first conveyance path, a second conveyance path, and a third conveyance path that are provided in the housing, the second conveyance path and the third conveyance path merging with the first conveyance path at a joining position, the image recording apparatus configured to record an image on a recording medium conveyed through the first conveyance path, the second conveyance path, and the third conveyance path, wherein the image recording apparatus further comprises a first guide member disposed at the joining position and configured to guide a sheet as the recording medium that is conveyed through the first conveyance path, and wherein (a) the first guide member is configured to be kept, in a normal state, at a first position at which the first guide member closes at least part of the first conveyance path and opens the second conveyance path and the third conveyance path to the first conveyance path, at the joining position and (b) the first guide member is configured to be moved, by contacting the sheet conveyed through the first conveyance path, to a second position at which the first guide member opens the first conveyance path and closes at least part of the second conveyance path and at least part of the third conveyance path with respect to the first conveyance path.

The present invention also provides an image recording apparatus comprising: a first tray and a second tray each configured to support a sheet as a recording medium; a housing; a first conveyance path, a second conveyance path, and a third conveyance path that are provided in the housing, the second conveyance path and the third conveyance path merging with the first conveyance path at a joining position, the image recording apparatus configured to record an image on the recording medium conveyed through the first conveyance path, the second conveyance path, and the third conveyance path, wherein the first conveyance path is configured to guide the sheet supplied from the first tray and includes a curved portion that curvedly extends upward from the first tray and an extending portion that is continuous to the curved portion, wherein the second conveyance path is configured to guide a media tray that is configured to support a recording medium and extends from a boundary between the extending portion and the curved portion of the first conveyance path in a direction opposite to a direction in which the extending portion extends, wherein the third conveyance path is configured to guide the sheet supplied from the second tray, the third conveyance path extending downward from the second tray and continuous to the extending portion, wherein the image recording apparatus further comprises a guide member disposed at the joining position and configured to guide the sheet conveyed through the first conveyance path, and wherein (a) the guide member is configured to be kept, in a normal state, at a first position at which the guide member closes at least part of the first conveyance path and opens the second conveyance path and the third conveyance path to the first conveyance path, at the joining position and (b) the guide member is configured to be moved, by contacting the sheet conveyed through the first conveyance path, to a second position at which the guide member opens the first conveyance path and closes at least part of the second conveyance path and at least part of the third conveyance path.

BRIEF DESCRIPTION OF THE DRAWINGS

The objects, features, advantages, and technical and industrial significance of the present invention will be better understood by reading the following detailed description of the embodiments of the invention, when considered in connection with the accompanying drawings, in which.

DETAILED DESCRIPTION OF THE EMBODIMENTS

There will be hereinafter explained a multi-function peripheral (MFP) 10 according to one embodiment of the invention with reference to the drawings. It is to be understood that the embodiment is described by way of example and the invention may be embodied otherwise without departing from the scope and spirit of the invention. The MFP 10 is used in a state shown in FIG. 1. In the following explanation, an up-down direction 7 is defined as an up-down direction of the MFP 10 in the state shown in FIG. 1. A front-rear direction 8 is defined by regarding a side of the MFP 10 on which an opening 13 is formed as a front side. A right-left direction 9 is defined in a state in which the MFP 10 is viewed from the front side.

Overall Structure of MFP 10

Figure 1:
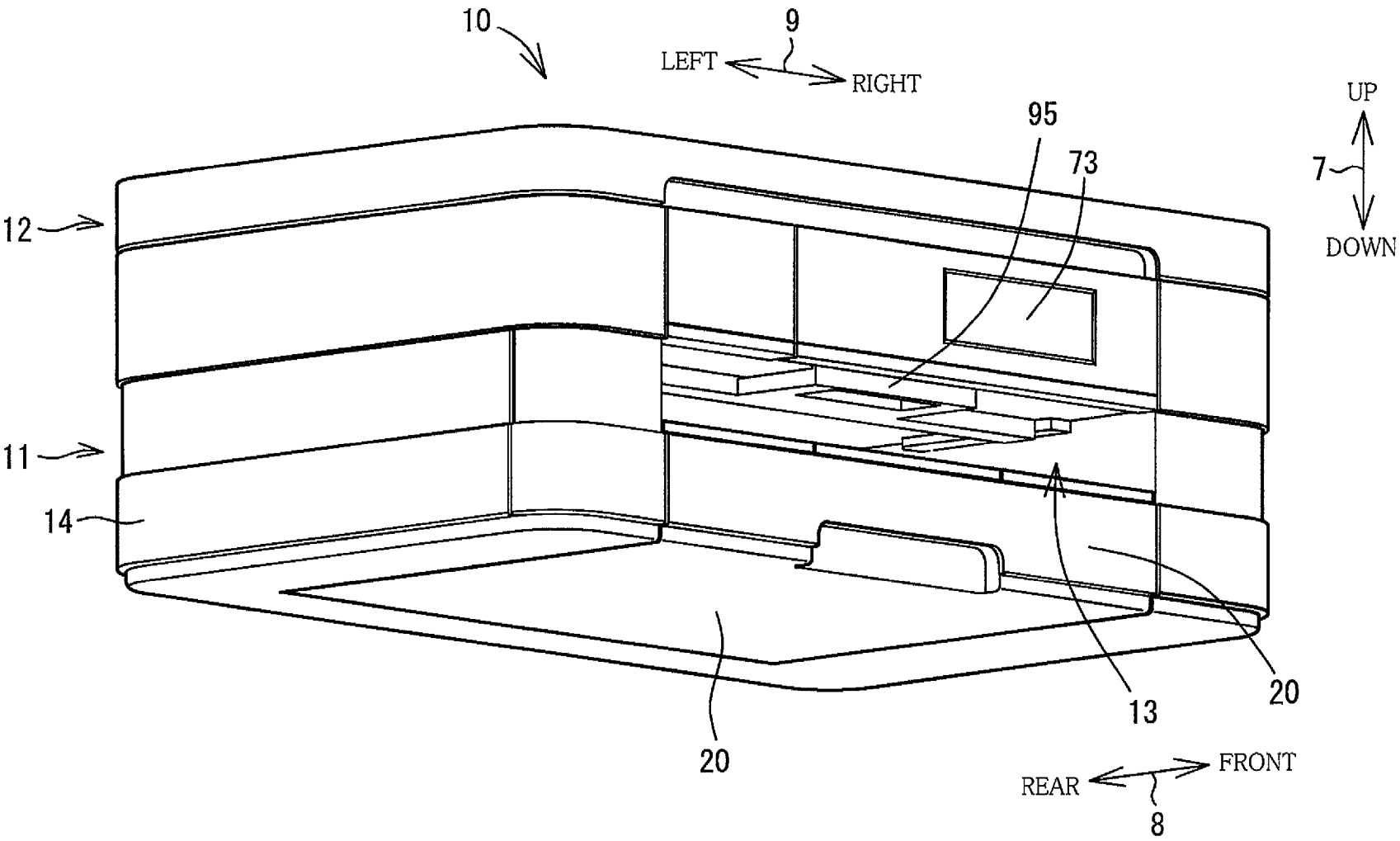
FIG. 1 is an external perspective view of a multi-function peripheral (MFP) according to one embodiment of the invention.

As shown in FIG. 1, the MFP 10 having a generally rectangular parallelepiped shape has a printer unit 11 (as one example of an image recording apparatus of the invention) configured to record an image on a sheet such as a recording sheet (as one example of a recording medium of the invention) according to an ink-jet recording technique. The MFP 10 has various functions such a facsimile function and a printing function. The MFP 10 has a function of recording an image on a surface of a recording medium such as a CD-ROM or a DVD-ROM having a larger thickness than the sheet.

Figure 7:
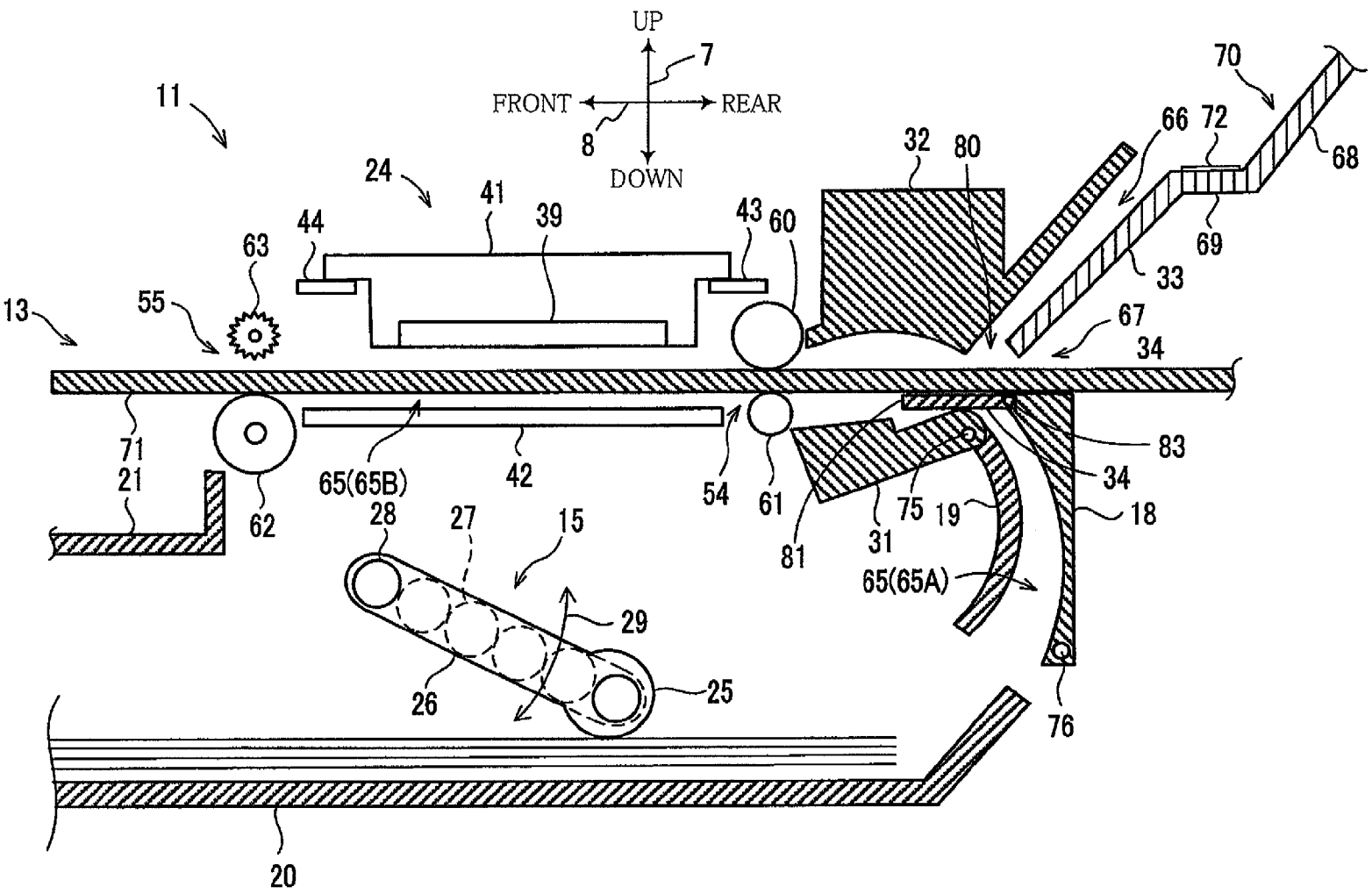
FIG. 7 is an elevational view in vertical cross section schematically showing the inner structure of the printer unit in a state in which a media tray is mounted.

In the present embodiment, the recording medium is conveyed through a straight path 65B and a label path 67 (that will be explained) while being supported by a plate-like media tray 71 (FIG. 7). In this instance, the recording medium is one example of a recording medium of the present invention, and the media tray 71 is one example of a conveyed medium of the present invention. The printer unit 11 may be configured such that a recording medium itself is conveyed through the straight path 65B and the label path 67. In this instance, the recording medium is one example of the recording medium of the present invention and is one example of the conveyed medium of the present invention.

The printer unit 11 has a housing 14 having an opening 13 formed in its front surface. There are provided, in the opening 13, a supply tray 20 (as one example of a first tray of the present invention) and an output tray 21 on which the recording sheets in various sizes can be supported. The supply tray 20 and the output tray 21 are insertable into and removable from the housing 14 through the opening 13 in the front-rear direction 8.

Figure 2:
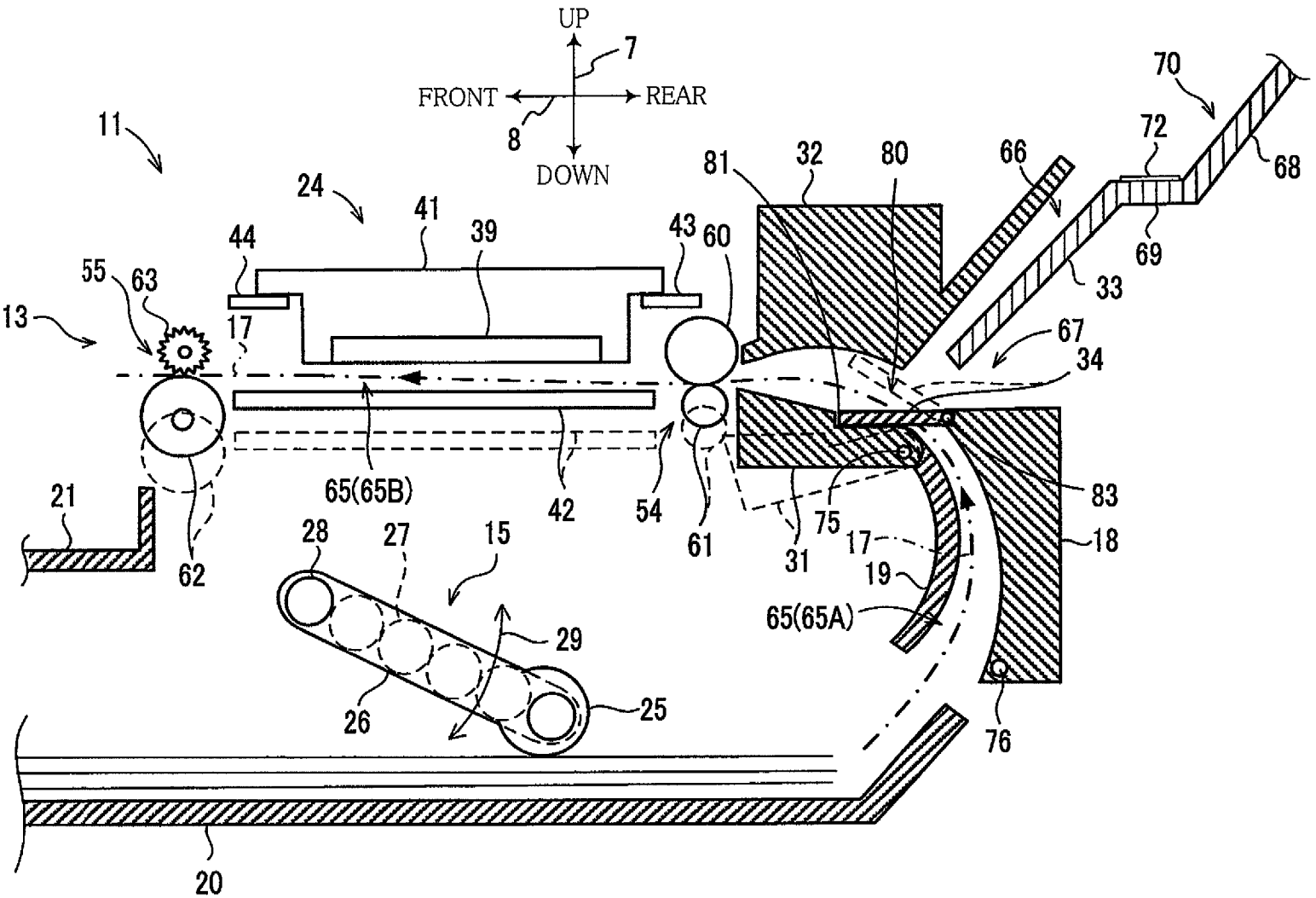
FIG. 2 is an elevational view in vertical cross section schematically showing an inner structure of a printer unit of the MFP of FIG. 1.

As shown in FIGS. 2 and 7, the printer unit 11 includes: a supply unit 15 configured to supply the recording sheet from the supply tray 20; a recording portion 24 configured to record an image on the recording sheet; a first conveyor roller pair 54 (as one example of a conveyor roller pair of the present invention) and a second conveyor roller pair 55 that are configured to convey the recording sheet and the media tray 71; a conveyance path 65 (as one example of a first conveyance path of the present invention); a label path 67 (as one example of a second conveyance path of the present invention); and a bypass path 66 (as one example of a third conveyance path of the present invention). In other words, there are disposed, in the housing 14, the supply unit 15, the recording portion 24, the first conveyor roller pair 54, and the second conveyor roller pair 55. There are formed, in the housing 14, the conveyance path 65, the label path 67, and the bypass path 66.

As shown in FIG. 1, a scanner unit 12 is provided over the printer unit 11. The scanner unit 12 is a flatbed scanner. Since the structure of the flatbed scanner is well known, its explanation is dispensed with.

Printer Unit 11

The printer unit 11 will be explained in detail.

Supply Tray 20

The supply tray 20 shown in FIGS. 1 and 2 is shaped like a box opening upward. The output tray 21 is disposed above the supply tray 20. The supply tray 20 is configured to support, on its support surface, a stack of recording sheets in various sizes such as an A4 size according to the Japanese Industrial Standards and an L size for photo printing. The supply tray 20 is disposed in an inner space of the housing 14 that is connected to the opening 13. The supply tray 20 is insertable into and retractable from the housing 14 in the front-rear direction 8 through the opening 13.

Supply Unit 15

As shown in FIG. 2, the supply unit 15 has a supply roller 25, a supply arm 26, and a driving-force transmitting mechanism 27. The supply unit 15 is disposed above the supply tray 20 and below the recording portion 24. The supply roller 25 is rotatably supported by a distal end portion of the supply arm 26. The supply arm 26 is configured to pivot about a shaft 28 provided at its proximal end portion in a direction indicated by an arrow 29. The pivotal movement of the supply arm 26 causes the supply roller 25 to be moved toward and away from the support surface of the supply tray 20. Consequently, the supply roller 25 can contact an uppermost one of the recording sheets stacked on the supply tray 20 when the supply tray 20 on which the recording sheets are stacked is mounted in the housing 14.

A driving force of a motor (not shown) is transmitted to the supply roller 25 via the driving-force transmitting mechanism 27. The driving-force transmitting mechanism 27 transmits rotation transmitted to the shaft 28 to a shaft of the supply roller 25 by a gear train composed of a plurality of gears meshing with one another. The supply roller 25 rotates while being in contact with the uppermost one of the recording sheets supported on the support surface of the supply tray 20, so that the uppermost recording sheet is supplied to the conveyance path 65.

Conveyance Path 65

As shown in FIG. 2, the conveyance path 65 provided in the inner space of the housing 14 curvedly extends upward from a rear end portion of the supply tray 20, then extends toward the front side, and finally reaches the output tray 21. The conveyance path 65 guides the recording sheet supplied from the supply tray 20. The conveyance path 65 is constituted by a curved path 65A (as one example of a curved portion of the present invention) and the straight path 65B (as one example of an extending portion of the present invention) that is continuous to the curved path 65A.

The curved path 65A is defined by: an outer guide member 18 (as one example of a second guide member of the present invention); and an inner guide member 19 and a guide member 31. The outer guide member 18 is opposed to the inner guide member 19 and the guide member 31 with a space interposed therebetween through which the recording sheet can pass. Since the straight path 65B extends substantially straight, the media tray 71 can pass therethrough without being bent. The straight path 65B is defined by: the recording portion 24 and a platen 42 that are opposed to each other with a space interposed therebetween through which the recording sheet and the media tray 71 can pass; and the guide member 31 and a guide member 32 (as one example of a fourth guide member of the present invention) that are opposed to each other with a space interposed therebetween through which the recording sheet and the media tray 71 can pass. The inner guide member 19 and the guide member 31 constitute one example of a third guide member of the present invention.

In the present embodiment, the entirety of the curved path 65A is defined by the outer guide member 18, the inner guide member 19, and the guide member 31. The outer guide member 18, the inner guide member 19, and the guide member 31 may define only part of the curved path 65A. In the present embodiment, the guide members 31, 32 define only part of the straight path 65B. The guide members 31, 32 may define the entirety of the straight path 65B.

The recording sheet supplied along the conveyance path 65 by the supply roller 25 of the supply tray 20 is conveyed upward from the lower side along the curved path 65A, then makes a U-turn, and is finally conveyed frontward from the rear side along the straight path 65B. That is, the recording sheet is conveyed in a conveyance direction 17 indicated by the dot-and-dash line in FIG. 2.

The outer guide member 18 provides an outer guide surface for guiding the recording sheet when the recording sheet is conveyed along the curved path 65A. The inner guide member 19 provides an inner guide surface for guiding the recording sheet when the recording sheet is conveyed along the curved path 65A. The guide member 31 provides a lower guide surface for guiding the recording sheet when the recording sheet is conveyed along the straight path 65B. The guide member 32 provides an upper guide surface for guiding the recording sheet when the recording sheet is conveyed along the straight path 65B. The guide member 32 also defines the bypass path 66 that will be explained. Each of the guide surfaces may be constituted by a single surface or a group of distal end faces of a plurality of ribs.

Pivotal Movement of Outer Guide Member 18

As shown in FIG. 4, the outer guide member 18 is pivotally supported by the housing 14. The outer guide member 18 defines part of the rear surface of the housing 14. The outer guide member 18 is supported by the housing 14 at shafts 76 respectively provided on lower right and left ends of the outer guide member 18.

Figure 4C:
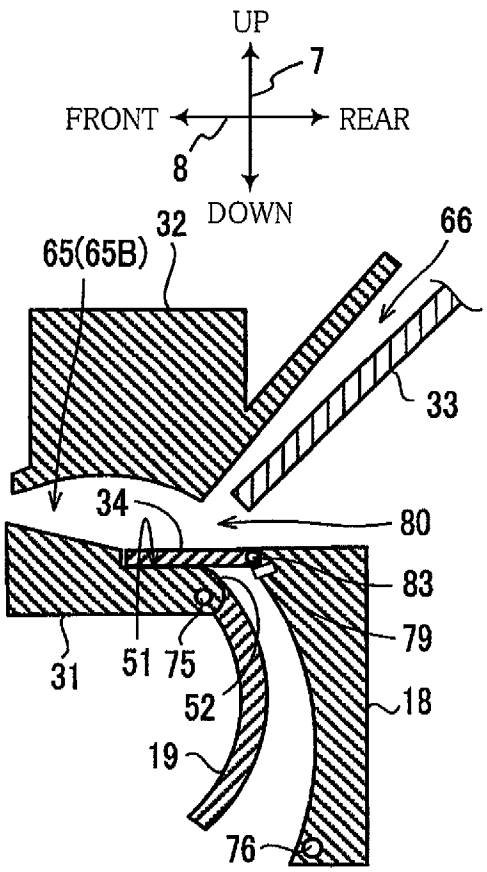
FIGS. 4A-4C are elevational views in vertical cross section schematically showing an inner structure of a rear portion of the printer unit 11 in an open state of an outer guide member (FIG. 4A), in a process in which a state of the outer guide member changes from the open state to a closed state (FIG. 4B), and in the closed state of the outer guide member (FIG. 4C)

As shown in FIGS. 2 and 4C, the outer guide member 18 provides the outer guide surface of the curved path 65A when the outer guide member 18 takes an upright posture with respect to the housing 14. A state of the outer guide member 18 in this instance corresponds to a closed state of the present invention. When the outer guide member 18 pivots about the shafts 76 with respect to the housing 14, namely, when an upper portion (a distal end portion) of the outer guide member 18 is inclined rearward with respect to the housing 14 as shown in FIG. 4A, the curved path 65A is opened or exposed outwardly of the housing 14. A state of the outer guide member 18 in this instance corresponds to an open state of the present invention.

The state of the outer guide member 18 may be changed between the closed state and the open state by any manner other than the pivotal movement, such as by attaching and detaching the outer guide member 18 to and from the housing 14.

First Conveyor Roller Pair 54 and Second Conveyor Roller Pair 55

As shown in FIG. 2, the first conveyor roller pair 54 is disposed upstream of the recording portion 24 in the conveyance direction 17 in the straight path 65B. The first conveyor roller pair 54 includes a first conveyor roller 60 and a pinch roller 61. The second conveyor roller pair 55 is dispose downstream of the recording portion 24 in the conveyance direction 17 in the straight path 65B. The second conveyor roller pair 55 includes a second conveyor roller 62 and a spur roller 63. The first conveyor roller 60 and the second conveyor roller 62 rotate by rotation of a motor (not shown) transmitted thereto.

Recording Portion 24

As shown in FIG. 2, the recording portion 24 is disposed between the first conveyor roller pair 54 and the second conveyor roller pair 55 in the straight path 65B. The recording portion 24 includes a carriage 41 and a recording head 39. The carriage 41 is supported by guide rails 43, 44 provided above the platen 42, so as to be reciprocatingly movable in the right-left direction 9. The guide rail 44 has a known belt mechanism. The carriage 41 is connected to an endless belt of the belt mechanism and reciprocates along the guide rails 43, 44 in the right-left direction 9 by a rotational movement of the endless belt. In a state in which the carriage 41 and the recording head 39 are opposed to the platen 42 with a space interposed therebetween, the carriage 41, the recording head 39, and the platen 42 define part of the straight path 65B.

The recording head 39 is mounted on the carriage 41. A plurality of nozzles (not shown) are formed in a lower surface of the recording head 39. Ink is supplied to the recording head 39 from an ink cartridge (not shown). The recording head 39 ejects minute ink droplets selectively from the nozzles. While the carriage 41 is moving in the right-left direction 9, the ink droplets are ejected from the nozzles toward the recording sheet conveyed through the straight path 65B or the recording medium supported by the media tray 71. The ejected ink droplets are attached to the recording sheet on the platen 42 or the recording medium on the media tray 71, so that an image is recorded on the recording sheet or the recording medium.

Movement of Each Roller Pair 54, 55, Platen 42, and Guide Member 31

A lower roller, i.e., the pinch roller 61 of the first conveyor roller pair 54, a lower roller, i.e., the second conveyor roller 62, of the second conveyor roller pair 55, and the platen 42 are movable in the up-down direction 7. Further, the guide member 31 is pivotable with respect to the housing 14 about a shaft 75 provided at a rear end portion of the guide member 31. In the present embodiment, the guide member 31 is pivotally supported by the inner guide member 19. The guide member 31 may be pivotally supported by any member, such as the housing 14, other than the inner guide member 19.

The pinch roller 61 and the second conveyor roller 62 are movable between: a contact position (indicated by the solid line in FIG. 2) at which the pinch roller 61 and the second conveyor roller 62 are in contact with the first conveyor roller 60 and the spur roller 63, respectively; and a distant position (indicated by the dashed line in FIG. 2) at which the pinch roller 61 and the second conveyor roller 62 are distant from the first conveyor roller 60 and the spur roller 63, respectively.

The movement of the pinch roller 61 and the second conveyor roller 62 described above is effectuated by a known structure. In the present embodiment, a lever 95 (FIG. 1) disposed in the inner space connected to the opening 13 and a support member (not shown) that supports the pinch roller 61 and the second conveyor roller 62 are coupled to each other. The support member moves in the up-down direction 7 when the lever 95 is moved by a user. The movement of the support member in the up-down direction 7 causes the pinch roller 61 and the second conveyor roller 62 to be moved between the contact position and the distant position. The movement of the pinch roller 61 and the second conveyor roller 62 may be effectuated by any other structure. For instance, the pinch roller 61 and the second conveyor roller 62 may be moved by a driving force produced by a motor (not shown).

When the pinch roller 61 and the second conveyor roller 62 are located at the contact position, the recording sheet can be nipped between the rollers of the first conveyor roller pair 54 and the rollers of the second conveyor roller pair 55. When the pinch roller 61 and the second conveyor roller 62 are located at the distant position, the media tray 71 can be nipped between the rollers of the first conveyor roller pair 54 and the rollers of the second conveyor roller pair 55. The first conveyor roller pair 54 and the second conveyor roller pair 55 are configured to convey the recording sheet or the media tray 71 along the straight path 65B and the label path 67 (that will be explained) in a state in which the recording sheet or the media tray 71 is nipped, by rotation of the first conveyor roller 60 and the second conveyor roller 62.

The platen 42 is movable between: an upper position (indicated by the solid line in FIG. 2) at which a distance, in the up-down direction 7, between the recording sheet supported by the platen 42 and the recording head 39 is equal to a suitable distance for image recording on the recording sheet; and a lower position (indicated by the dashed line in FIG. 2 and indicated in FIG. 7) which is lower than the upper position and which is located below the media tray 71 conveyed through the straight path 65B. The movement of the platen 42 is effectuated by a known structure similar to that for the movement of the rollers 61, 62. For instance, a support member that supports the platen 42 is coupled to the lever 95 described above, and a movement of the support member in the up-down direction 7 in conjunction with the lever 95 causes the platen 42 to be moved in the up-down direction 7.

The guide member 31 is pivotable between: a first pivot position (indicated by the dashed line in FIG. 2) for guiding the recording sheet through the conveyance path 65; and a second pivot position (indicated by the dashed line in FIG. 2) for guiding the media tray 71 through the straight path 65B. When the guide member 31 is located at the second pivot position, the distal end portion of the guide member 31 is located at a position lower than that when the guide member 31 is located at the first pivot position. The pivotal movement of the guide member 31 is effectuated by a known structure. For instance, the guide member 31 is supported by a support member coupled to the lever 95 described above so as to be kept located at the first pivot position, and the guide member 31 pivots from the first pivot position to the second pivot position when supporting of the guide member 31 by the support member is canceled. Further, the guide member 31 pivots from the second pivot position to the first pivot position by being lifted up by the support member that moves in conjunction with the movement of the lever 95. The guide member 31 may be moved by any manner other than the pivotal movement such as sliding in the up-down direction 7.

Recessed Portions 51 of Guide Member 31

Figure 5:
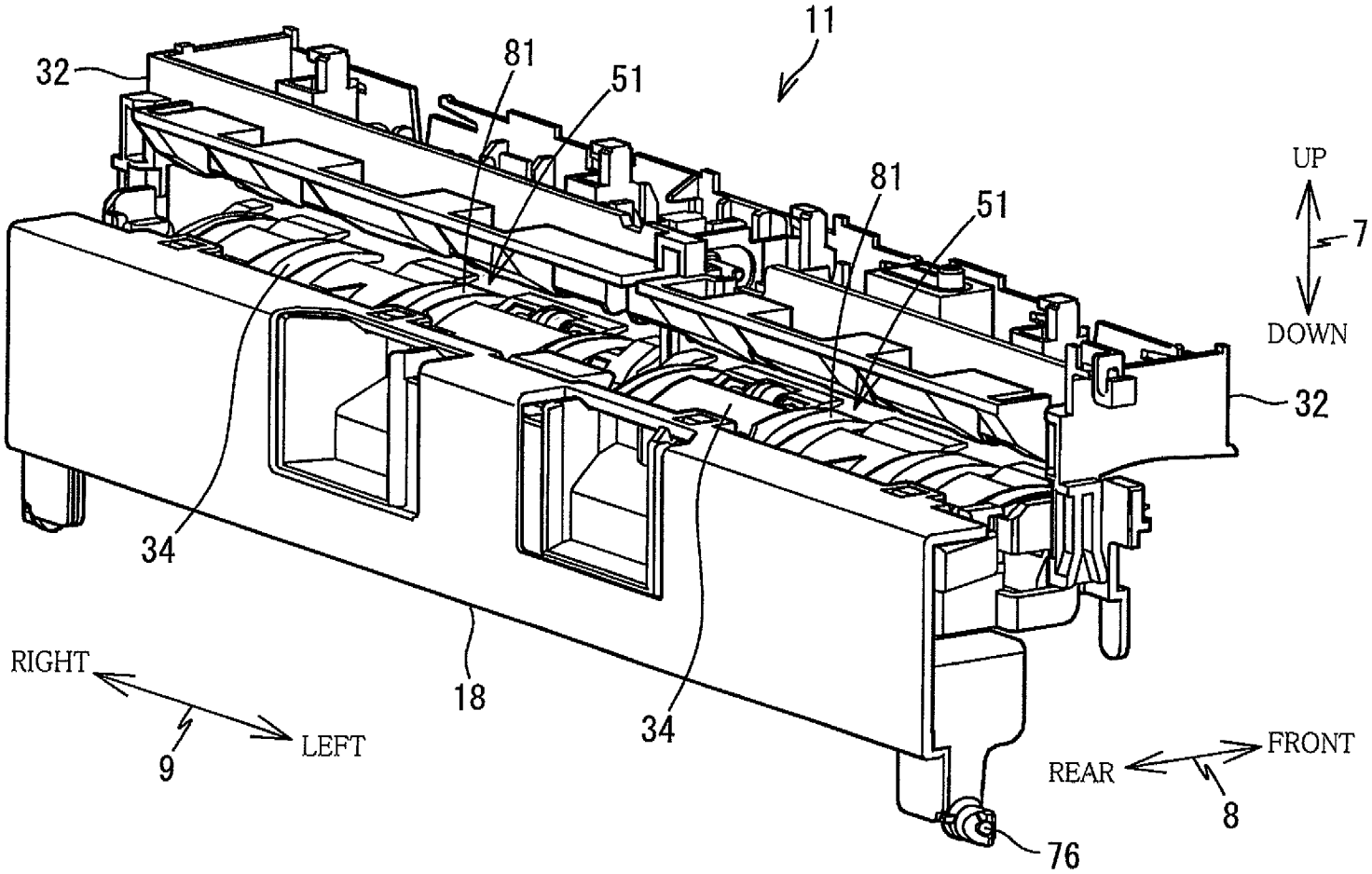
FIG. 5 is a perspective view showing the rear portion of the printer unit when the guide member (34) is located at a first position.
Figure 6:
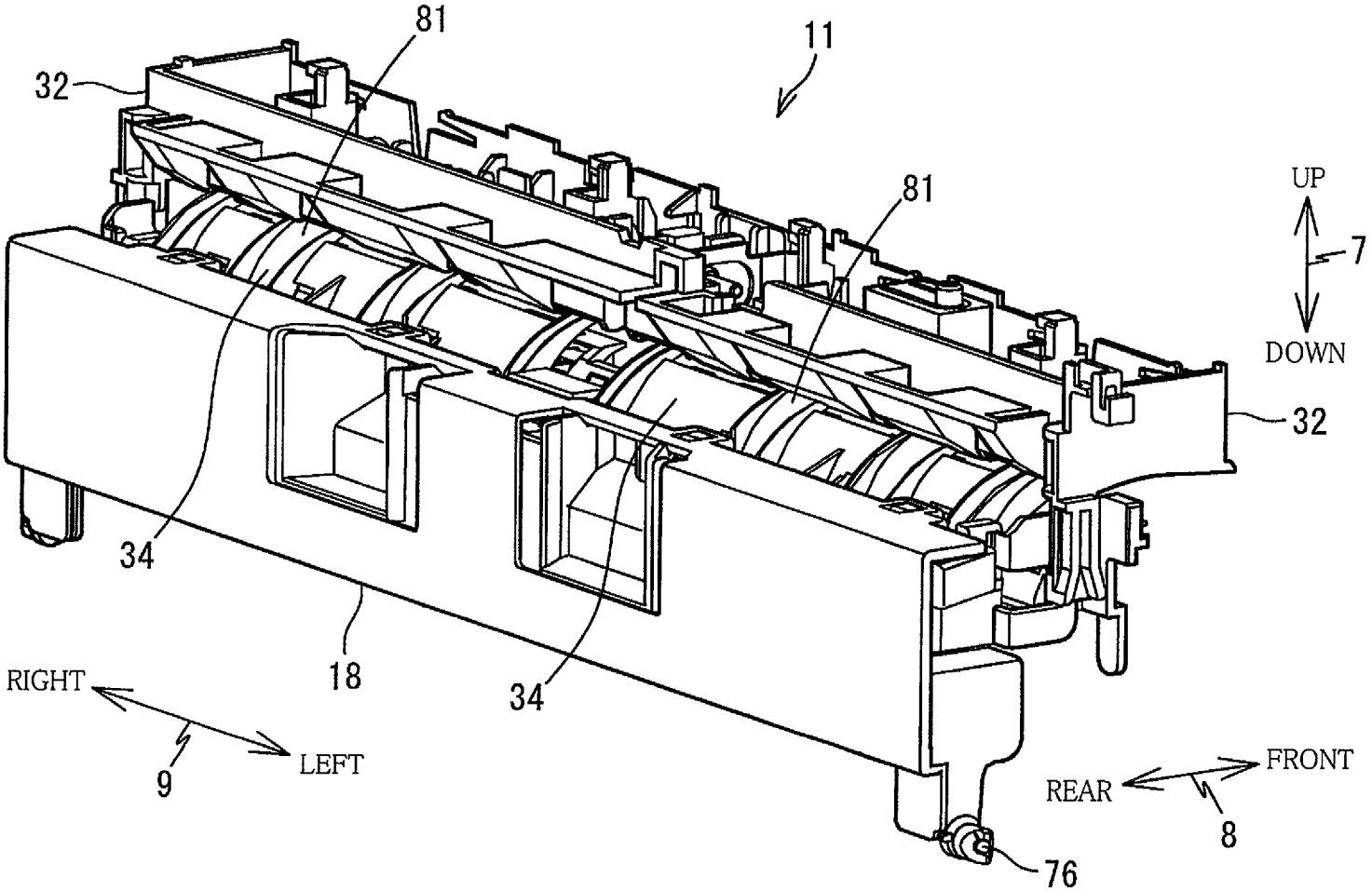
FIG. 6 is a perspective view showing the rear portion of the printer unit when the guide member (34) is located a second position.

As shown in FIGS. 5 and 6, the guide member 31 has recessed portions 51. The recessed portions 51 are formed so as to be spaced apart from one another in the right-left direction 9. The positions of the recessed portions 51 in the right-left direction 9 correspond to positions of pivotal distal ends of a guide member 34 that will be explained.

Label Path 67

As shown in FIG. 2, the label path 67 is formed in the housing 14. The label path 67 extends backward from a boundary between the curved path 65A and the straight path 65B in the conveyance path 65. The label path 67 and the straight path 65B constitute a single path extending substantially in the front-rear direction 8. The label path 67, together with the straight path 65B, can guide the media tray 71 without being bent.

The label path 67 is defined by the outer guide member 18 and a guide member 33 that are opposed to each other with a space interposed therebetween through which the media tray 71 can pass.

The label path 67 may be configured such that the media tray 71 passes therethrough while being in contact with the outer guide member 18 or the guide member 33. Alternatively, the label path 67 may be configured such that the media tray 71 passes therethrough without contacting any of the outer guide member 18 and the guide member 33. In other words, "the label path 67 can guide the media tray 71" not only means that the media tray 71 passes through the label path 67 while being in contact with the outer guide member 18 or the guide member 33, but also means that the media tray 71 passes through the label path 67 without contacting any of the outer guide member 18 and the guide member 33.

Bypass Path 66

As shown in FIG. 2, the bypass path 66 is formed in the housing 14. The bypass path 66 is formed above and rearward of the straight path 65B so as to extend toward the conveyance path 65, namely, toward the straight path 65B in the present embodiment. The bypass path 66 extends, in the housing 14, obliquely from the upper right to the lower left in FIG. 2 and from the rear side toward the front side in the front-rear direction 8. The bypass path 66 is connected to the straight path 65B at a joining position 80 at which the straight path 65B and the label path 67 merge with each other. The bypass path 66 is located at a higher position than any of the curved path 65A, the straight path 65B, and the label path 67. The bypass path 66 is defined by the guide member 32 and the guide member 33 that are opposed to each other with a space interposed therebetween through which the recording sheet can pass.

The recording sheet supported by a bypass tray 70 (that will be explained) is guided obliquely from the upper right to the lower left in FIG. 2 along the bypass path 66. The recording sheet is then guided along the straight path 65B of the conveyance path 65 and is conveyed by the first conveyor roller pair 54. The recording sheet is thereafter subjected to image recording performed by the recording portion 24 and is finally discharged to the output tray 21.

Bypass Tray 70

As shown in FIG. 2, the bypass tray 70 (as one example of a second tray of the present invention) is provided above the outer guide member 18 on the rear side of the MFP 10. The bypass tray 70 is configured to support the recording sheets independently of the supply tray 20.

The bypass tray 70 includes a support portion 68 for supporting the recording sheets and a contact portion 69 with which leading edges of the recording sheets that are supported by the support portion 68 are in contact. The contact portion 69 connects the support portion 68 and the guide member 33.

A separation member 72 is provided on the contact portion 69. The leading edges of the recording sheets that are supported by the bypass tray 70 are in contact with an upper surface of the separation member 72. A plurality of teeth (not shown) that are arranged in the front-rear direction 8 are formed on the upper surface of the separation member 72 so as to protrude upward from the upper surface.

While not shown, the bypass tray 70 is provided with a supply unit having a structure similar to that of the supply unit 15. The supply unit has a supply roller disposed above the support portion 68. The supply roller rotates by a driving force transmitted thereto from a motor, so that an uppermost one of the recording sheets supported by the support portion 68 of the bypass tray 70 is supplied to the bypass path 66. The uppermost sheet is separated by the teeth of the separation member 72 from other sheets present under the uppermost sheet. Consequently, the other sheets present under the uppermost sheet are kept supported on the bypass tray 70 without being dragged together with the uppermost sheet.

Guide Member 34

Figure 3A:
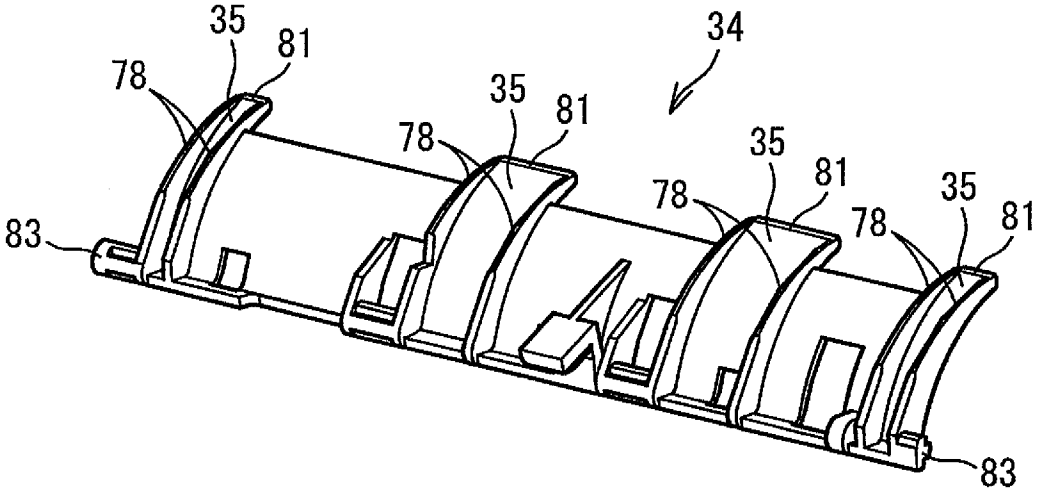
FIGS. 3A and 3B are external perspective views each showing a guide member (34)
Figure 3B:
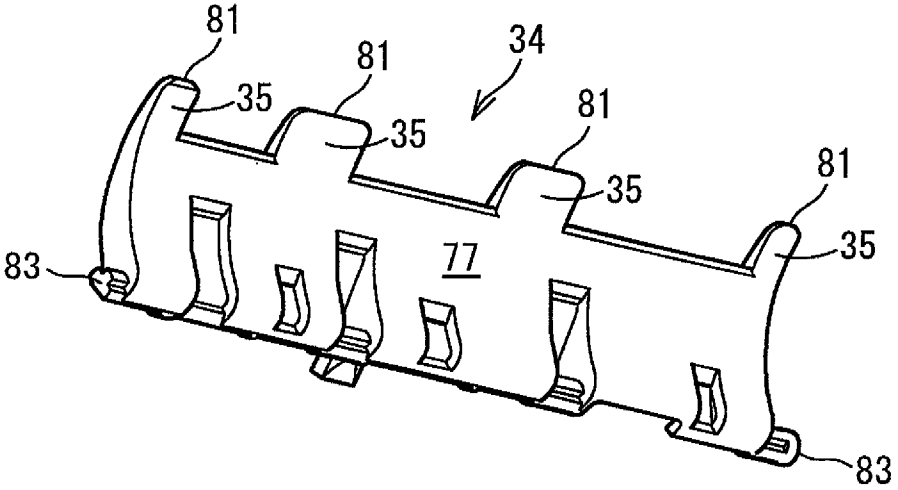

As shown in FIG. 2, the guide member 34 (as one example of a first guide member) is disposed at a portion of the curved path 65A near to the straight path 65B. The guide member 34 has a curved plate-like shape shown in FIG. 3. It is noted that a plurality of guide members 34 may be provided so as to be spaced apart from one another in the right-left direction 9 (as one example of a width direction of the present invention). In this instance, each of the plurality of guide members 34 is one example of a guide of the present invention.

The guide member 34 is pivotally supported by the outer guide member 18. Specifically, the guide member 34 is pivotally supported, by the outer guide member 18, at shafts 83 respectively provided at right and left ends of its rear-side portion.

When the outer guide member 18 is in the closed state, the guide member 34 is pivotable between a first position indicated by the solid line in FIG. 2 and a second position indicated by the dashed line in FIG. 2, such that its downstream side in the conveyance direction 17, namely, its rear side, functions as a proximal end side while its front side functions as a pivotal distal end side. When the outer guide member 18 is in the open state shown in FIG. 4A, the guide member 34 is pivotable also toward a third position. The third position indicated by the solid line in FIG. 4A is located on one of opposite sides of the first position remote from the second position. In FIG. 4A, the guide member 34 located at the first position is illustrated by the dashed line while the guide member 34 located at the second position is illustrated by the dot-and dash line.

It is noted that the guide member 34 may be supported by any member, such as the housing 14, other than the outer guide member 18.

In a state in which the guide member 34 is located at the first position, the guide member 34 is located below the joining position 80 and below the label path 67.

When the guide member 34 is located at the second position, a lower surface 77 (FIG. 3) of the guide member 34, together with the outer guide member 18, defines part of an outer periphery of the curved path 65A. A plurality of ribs 78 (each of which may be regarded as one example of a guide of the present invention) are formed on a backside of the lower surface 77 of the guide member 34 so as to be spaced apart from one another in the right-left direction 9. When the guide member 34 is located at the first position, the ribs 78, together with the guide member 31, define part of a lower periphery of the straight path 65B. That is, the guide member 34 guides the recording sheet conveyed through the conveyance path 65.

As shown in FIG. 3, the guide member 34 has a plurality of protruding portions 35 that protrude from a downstream-side portion of the guide member 34 in the conveyance direction 17. A distal end of each protruding portion 35 functions as a pivotal distal end 81 of the guide member 34. In the state in which the guide member 34 is located at the first position, the protruding portions 35 are fitted in the respective recessed portions 51 of the guide member 31. Each protruding portion 35 may be entirely fitted in the corresponding recessed portion 51. Alternatively, each protruding portion 35 may be fitted in the corresponding recessed portion 51 such that an upper section of the protruding portion 35 protrudes from the recessed portion 51.

In a normal state in which no external force is applied to the guide member 34, the protruding portions 35 of the guide member 34 are supported by the guide member 31, as shown in FIG. 2. The guide member 34 is thus held at the first position. It is noted that the protruding portions 35 of the guide member 34 may be supported by any member, such as the housing 14, other than the guide member 31.

As described above, when the guide member 34 is located at the first position, the portion thereof on the pivotal proximal end side is supported by the outer guide member 18 while the protruding portions 35 on the pivotal distal end side are supported by the guide member 31. Consequently, the guide member 34 located at the first position closes the curved path 65A of the conveyance path 65 at the joining position 80. Further, the guide member 34 located at the first position is distant from the guide member 32. Thus, the label path 67 and the bypass path 66 are opened to the conveyance path 65 at the joining position 80.

The guide member 34 located at the first position need not necessarily close the curved path 65A of the conveyance path 65 entirely at the joining position 80. For instance, the guide member 34 located at the first position may close only part of the curved path 65A at the joining position 80 on the condition that a possibility of entry, into the straight path 65B, of the recording sheet conveyed through the curved path 65A in the conveyance direction 17 can be reduced.

The guide member 34 is pushed upward by the recording sheet conveyed through the curved path 65A in the conveyance direction 17, whereby the guide member 34 pivots from the first position to the second position. In a state in which the guide member 34 is located at the second position, a generally central portion of the guide member 34 in the front-rear direction 8 is located at the joining position 80.

When the guide member 34 pivots from the first position to the second position, the pivotal distal ends 81 of the guide member 34 are separated away from the guide member 31, so that the curved path 65A is opened. Further, when the guide member 34 pivots from the first position to the second position, the pivotal distal ends 81 of the guide member 34 come into contact with a lower surface of the guide member 32, as indicated by the dashed line in FIG. 2. As a result, the guide member 34 closes the label path 67 and the bypass path 66 with respect to the conveyance path 65.

The guide member 34 located at the second position need not necessarily close the label path 67 and the bypass path 66 entirely with respect to the conveyance path 65. For instance, the guide member 34 may only partially close the label path 67 and the bypass path 66 with respect to the conveyance path 65 on the conditions that the media tray 71 cannot be conveyed between the straight path 65B and the label path 67 and that the recording sheet cannot be conveyed from the bypass path 66 to the straight path 65B.

To only partially close part of each of the curved path 65A, the label path 67, and the bypass path 66 includes a case in which, where a plurality of guide members 34 are provided so as to be spaced from one another in the right-left direction 9, a space between any adjacent two guide members 34 does not close each path.

The pivotal distal ends 81 of the guide member 34 located at the second position are located downstream of the joining position 80 in the conveyance direction 17. It is thus possible to prevent, with high reliability, the recording sheet that is being conveyed from the curved path 65A to the straight path 65B in the conveyance direction 17 from being erroneously enter the label path 67 or the bypass path 66.

Stopper 79 of Outer Guide Member 18 and Curved Surfaces 52 of the Guide Member 34

As shown in FIG. 4, the outer guide member 18 has a stopper 79 configured to restrict the pivotal movement of the guide member 34 from the first position to the third position such that the guide member 34 stops at the third position. In the present embodiment, the stopper 79 is a contact piece formed at a position of the outer guide member 18 located under the guide member 34. The stopper 79 contacts the lower surface 77 of the guide member 34 located at the third position from below. It is thus possible to prevent the guide member 34 from pivoting further downward beyond the third position.

As shown in FIG. 4, the guide member 31 has, on the rear side of each recessed portion 51, a curved surface 52 (as one example of a guide portion of the present invention) that is curved downward.

When the state of the outer guide member 18 changes from the closed state (FIG. 4C) to the open state (FIG. 4A) as a result of its pivotal movement, the pivotal distal ends 81 of the guide member 34 are separated away from the guide member 31. Consequently, the guide member 34 is not supported by the guide member 31 any more and hence pivots from the first position to the third position (FIG. 4A) by its own weight. Since the guide member 34 that has pivoted to the third position comes into contact with the stopper 79, the guide member 31 is inhibited from pivoting further downward.

Figure 4B:
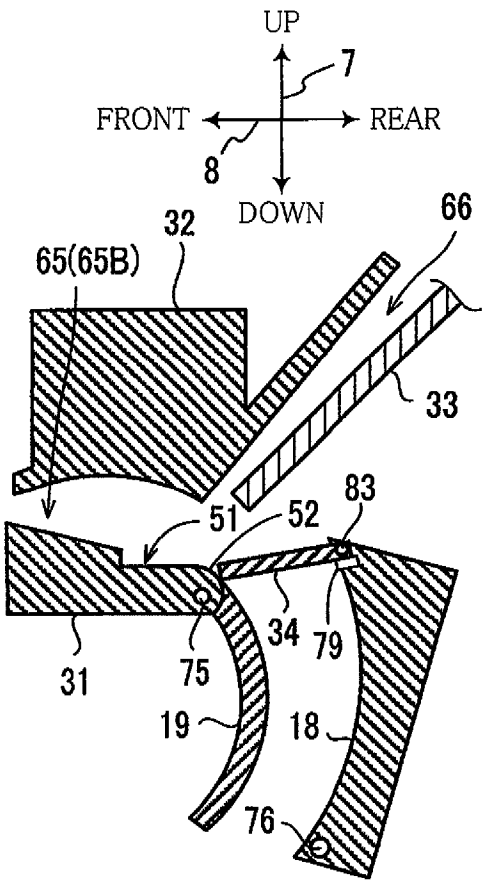
Figure 4A:
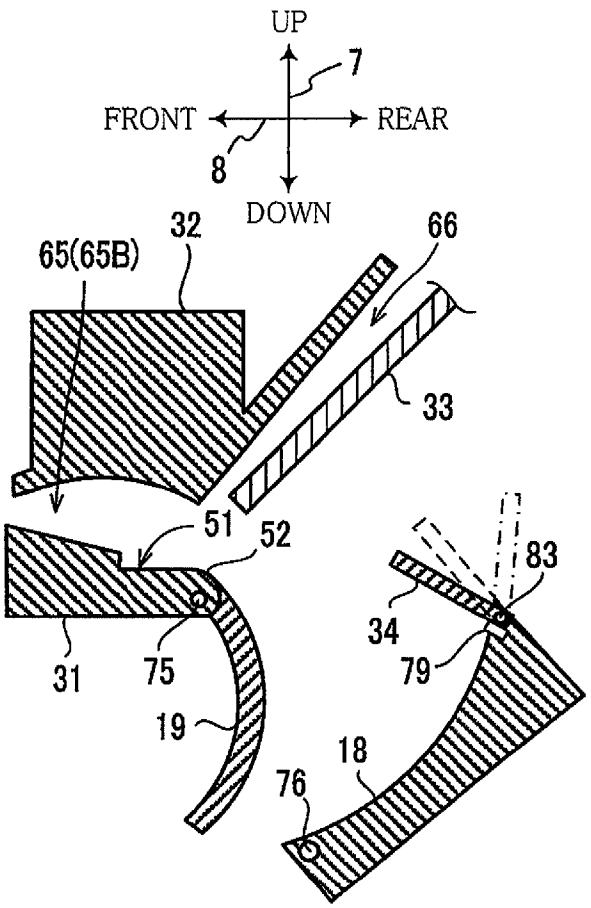

In a process in which the state of the outer guide member 18 changes from the open state to the closed state by its pivotal movement, the pivotal distal ends 81 of the guide member 34 come into contact with the respective curved surfaces 52 of the guide member 31, as shown in FIG. 4B. When the outer guide member 18 further pivots in this state, the guide member 34 pivots from the third position to the first position while being guided by the curved surfaces 52. When the state of the outer guide member 18 is changed to the closed state, the guide member 34 is located at the first position.

Image Recording Operation on Recording Sheet

When a user operates an operation panel 73 (FIG. 1) provided on an upper portion of the front surface of the MFP 10 and a controller (not shown) of the MFP 10 thereby commands image recording on the recording sheet supported by the supply tray 20, the supply roller 25 rotates. Consequently, the recording sheet supported by the supply tray 20 is supplied to the curved path 65A and is conveyed through the curved path 65A in the conveyance direction 17.

When the leading edge of the recording sheet in the conveyance direction 17 comes into contact with the guide member 34 located at the first position by its own weight, the guide member 34 is pushed upward by the recording sheet and pivots from the first position to the second position, so that the guide member 34 is separated away from the guide member 31. As a result, the curved path 65A and the straight path 65B closed by the guide member 34 are connected to each other. The recording sheet is then conveyed from the curved path 65A to the straight path 65B while being guided by the lower surface 77 (FIG. 3B) of the guide member 34. In this instance, the guide member 34 located at the second position prevents the recording sheet from entering the bypass path 66 or the label path 67 from the conveyance path 65 and prevents the recording sheet from getting caught on the guide member 33.

The recording sheet subsequently passes under the recording portion 24. In this instance, the recording head 39 of the recording portion 24 ejects ink droplets onto the recording sheet that is being conveyed, so that an image is recorded on the recording sheet. The recording sheet is thereafter discharged to the exterior of the MFP 10 through the opening 13 and is finally supported on the output tray 21.

When the user operates the operation panel 73 (FIG. 1) and the controller of the MFP 10 thereby commands image recording on the recording sheet supported by the support portion 68 of the bypass tray 70, the supply roller (not shown) disposed so as to be opposed to the support portion 68 rotates. Consequently, the recording sheet supported by the support portion 68 is supplied to the straight path 65B via the bypass path 66. The recording sheet entered the straight path 65B from above the same 65B comes into contact with the ribs 78 (FIG. 3A) of the guide member 34 located at the first position and is guided in the conveyance direction 17 by the ribs 78, so that the recording sheet is conveyed through the straight path 65B in the conveyance direction 17. In this instance, the guide member 34 located at the first position prevents entry of the recording sheet from the straight path 65B into the curved path 65A. Thereafter, an image is recorded on the recording sheet by the recording portion 24 and is finally supported by the output tray 21.

Image Recording Operation on Recording Medium Supported by Media Tray 71

Initially, the lever 95 is moved forward by the user, so that each of the roller pairs 54, 55 and the platen 42 are moved to the lower position and the guide member 31 pivots to the second pivot position. Subsequently, the media tray 71 on which the recording medium is supported is inserted by the user into the MFP 10 while being supported by a tray guide (not shown) provided in the inner space connected to the opening 13. In this instance, the leading end portion of the media tray 71 is located between the first conveyor roller 60 and the second conveyor roller 62.

When the user operates the operation panel 73 (FIG. 1) in this state and the controller (not shown) of the MFP 10 thereby commands image recording on the recording medium, the first conveyor roller 60 and the second conveyor roller 62 rotate forward. As a result, the media tray 71 is conveyed in the backward direction that is opposite to the conveyance direction 17 and subsequently reaches the label path 67 via the straight path 65B. That is, the media tray 71 is inserted from the most downstream side of the straight path 65B in the conveyance direction 17 and reaches the label path 67. The media tray 71 is conveyed in the backward direction until the surface of the recording medium becomes opposed to the recording portion 24.

Since the guide member 34 located at the first position is located below the label path 67, the media tray 71 that is being conveyed does not come into contact with the guide member 34.

Subsequently, the controller controls rotation of the first conveyor roller 60 and the second conveyor roller 62 to be changed from forward rotation to reverse rotation, so that the media tray 71 is conveyed in the forward direction. While the media tray 71 is conveyed in the forward direction, the recording head 39 ejects ink droplets on the recording medium supported by the media tray. Thus, an image is recorded on the surface of the recording medium. Thereafter, the media tray 71 is discharged to the exterior of the MFP 10 through the opening 13.

In a state in which the media tray 71 conveyed backward has reached the label path 67, the media tray 71 may protrude or need not protrude from the rear surface of the MFP 10 through an opening (not shown) formed in the rear surface. Where the media tray 71 does not protrude from the rear surface of the MFP 10, the opening need not be formed.

In the present embodiment, the media tray 71 is inserted into the MFP 10 from its front side. The media tray 71 may be inserted into the MFP 10 from its rear side.

Advantageous Effects

In the illustrated embodiment, the recording sheet that is being conveyed through the conveyance path 65 comes into contact with the guide member 34, whereby the guide member 34 is moved from the first position to the second position. That is, the guide member 34 can be moved independently of any other member. When the guide member 34 is located at the first position, at least part of the conveyance path 65 is closed at the joining position 80, thereby reducing a risk that the recording sheet conveyed through the label path 67 and the bypass path 66 erroneously enters the conveyance path 65. When the guide member 34 is located at the second position, at least part of the label path 67 and at least part of the bypass path 66 are closed with respect to the conveyance path 65, thereby reducing a risk that the recording sheet conveyed through the conveyance path 65 erroneously enters the label path 67 or the bypass path 66. Thus, the recording sheet can be conveyed with high stability in the structure in which the three paths merge with one another.

In the illustrated embodiment, when the guide member 34 is located at the second position, at least part of the label path 67 and at least part of the bypass path 66 are closed with respect to the conveyance path 65, so that the recording sheet conveyed through the curved path 65A can be guided to the straight path 65B while preventing entry of the recording sheet into the label path 67 or the bypass path 66.

In the illustrated embodiment, the label path 67 extends in a direction opposite to a direction in which the straight path 65B extends. The label path 67 and the straight path 65B thus can guide not only the recording sheet, but also the conveyed medium having high rigidity.

In the illustrated embodiment, an image can be recorded on not only the recording sheet, but also the recording medium supported by the media tray 71 having high rigidity.

In the illustrated embodiment, when the guide member 34 is located at the second position, the recording sheet conveyed through the conveyance path 65 is guided by the guide member 34 and reaches downstream of the joining position 80 in the straight path 65B in the conveyance direction 17. The recording sheet is then conveyed toward the first conveyor roller pair 54. Consequently, there is substantially no risk that the recording sheet that has reached the straight path 65B while being guided by the guide member 34 returns upstream of the pivotal distal end of the guide member 34 in the conveyance direction 17 and thereafter enters the label path 67 or the bypass path 66. Further, there is substantially no risk that the recording sheet that has reached the straight path 65B while being guided by the guide member 34 gets caught on the guide member 33, etc., that constitute the paths 66, 67, etc., at the joining position 80 located upstream of the pivotal distal end of the guide member 34 in the conveyance direction 17.

In the illustrated embodiment, the guide member 34 located at the first position shuts off communication between the curved path 65A and the straight path 65B, whereby it is possible to prevent the recording sheet that is conveyed through the straight path 65B, the label path 67, and the bypass path 66 from erroneously entering the curved path 65A.

In the illustrated embodiment, the guide member 34 located at the first position is located below the label path 67. It is thus possible to prevent the guide member 34 from contacting the media tray 71 that is conveyed through the label path 67 and consequently being damaged.

In the illustrated embodiment, the guide member 34 can guide the recording sheet conveyed from the bypass path 66 as well as the recording sheet conveyed from the conveyance path 65.

In the illustrated embodiment, when the outer guide member 18 is in the open state, the guide member 34 is located, by its own weight, at the third position that is the lowest position among the positions at which the guide member 34 can be located. In the process in which the state of the outer guide member 18 is changed to the closed state, the guide member 34 located at the third position is guided by the curved surfaces 52 from the third position to the first position. Thus, when the outer guide member 18 that has been in the open state for removal of the recording sheet jammed in the curved path 65A is placed again in the closed state, it is possible to prevent the guide member 34 from getting caught on other members, whereby the state of the outer guide member 18 can be changed into the closed state without being hindered by the guide member 34.

In the illustrated embodiment in which the guide member 31 has the recessed portions 51, the guide member 34 at the first position can be located at a lower position with respect to the guide member 31 than in a case in which the guide member 31 does not have the recessed portions 51. It is thus possible to reduce a space required for the guide member 34 and the guide member 31.

Modified Embodiment

Figure 8:
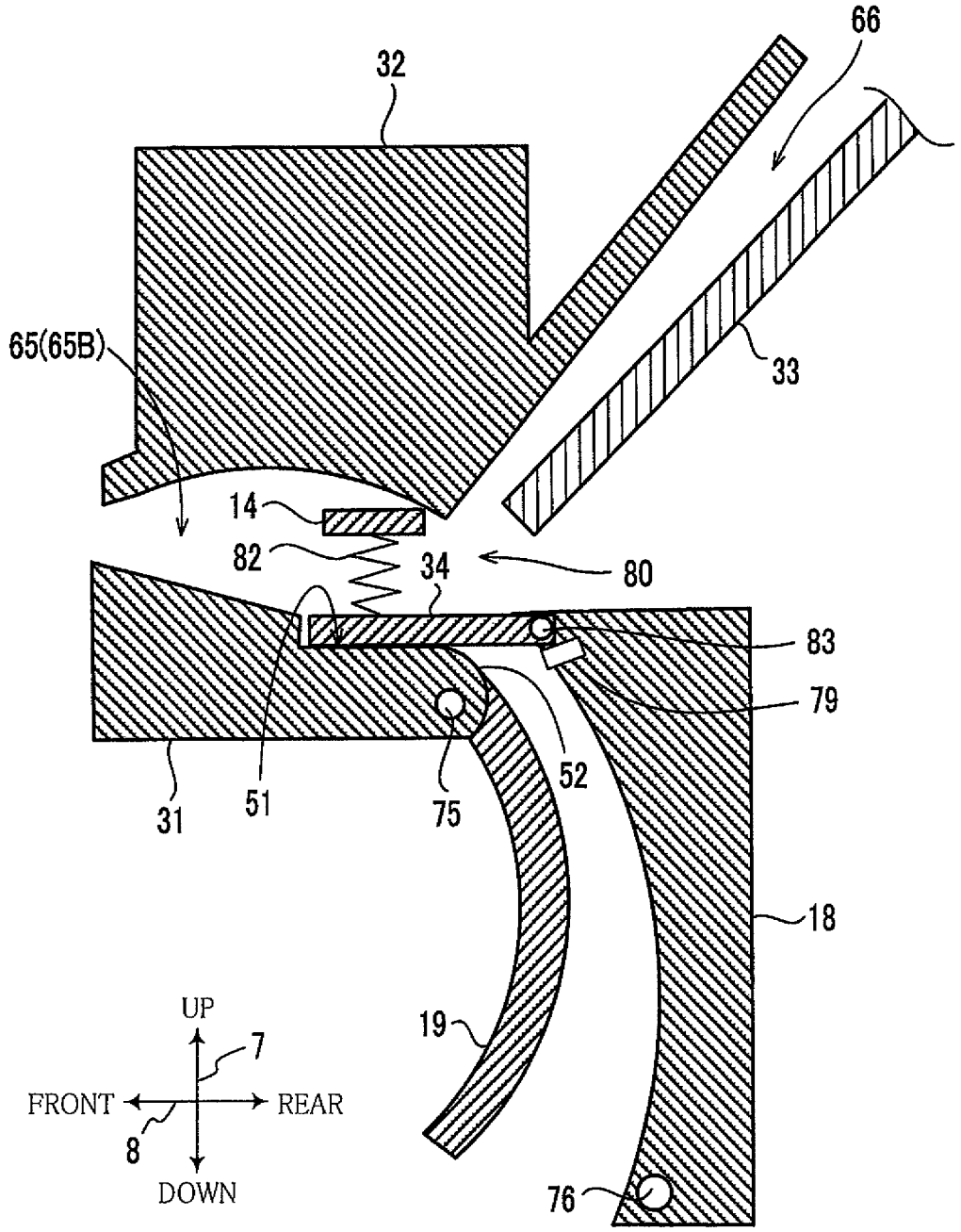
FIG. 8 is an elevational view in vertical cross section schematically showing part of a housing, the guide member (34), the outer guide member, and a coil spring according to a modified embodiment.

In the illustrated embodiment, the guide member 34 is kept at the first position by its own weight. The printer unit 11 may have a forcing member that forces the guide member 34 in a direction from the second position toward the first position, i.e., downward. For instance, a coil spring 82 shown in FIG. 8 functions as the forcing member. The coil spring 82 is disposed outwardly of the conveyance path 65 in the right-left direction 9. One end of the coil spring 82 is attached to the guide member 34 while another end thereof is attached to the housing 14 at a higher position than that of the one end. The forcing member is not limited to the coil spring 82. The guide member 34 is forced downward by the coil spring 82, so that the position of the guide member 34 can be stabilized.

The position and the direction of extension of each of the paths 65, 66, 67 are not limited to those of the illustrated embodiment, as long as the guide member 34 is movable between the first position (at which the guide member 34 closes the conveyance path 65 at the joining position 80 and opens the paths 66, 67 with respect to the conveyance path 65) and the second position (at which the guide member 34 opens the conveyance path 65 and closes the paths 66, 67 with respect to the conveyance path 65).

What is claimed is:

1. An image recording apparatus comprising: a housing; and a first conveyance path, a second conveyance path, and a third conveyance path that are provided in the housing, the second conveyance path and the third conveyance path merging with the first conveyance path at a joining position, the image recording apparatus configured to record an image on a recording medium conveyed through the first conveyance path, the second conveyance path, and the third conveyance path, wherein the image recording apparatus further comprises a first guide member disposed at the joining position and configured to guide a sheet as the recording medium that is conveyed through the first conveyance path, and wherein (a) the first guide member is configured to be kept, in a normal state, at a first position at which the first guide member closes an upstream portion of the first conveyance path located upstream of the joining position with respect to a downstream portion of the first conveyance path located downstream of the joining position and opens the second conveyance path and the third conveyance path with respect to the downstream portion of the first conveyance path, at the joining position and (b) the first guide member is configured to be moved, by contacting the sheet conveyed through the first conveyance path, to a second position at which the first guide member opens the upstream portion of the first conveyance path with respect to the downstream portion thereof and closes at least part of the second conveyance path and at least part of the third conveyance path with respect to the downstream portion of the first conveyance path, wherein the image recording apparatus further comprises a first tray configured to support the sheet, wherein the first conveyance path includes a curved portion that curvedly extends upward from the first tray and an extending portion that is continuous to the curved portion, the first conveyance path being defined by a second guide member that defines at least part of the curved portion and a third guide member that is disposed so as to be opposed to the second guide member and that defines at least part of the curved portion and at least part of the extending portion, wherein the first guide member is pivotally supported by the second guide member such that the first guide member is pivotable not only toward the second position that is located on one of opposite sides of the first position, but also toward a third position that is located on the other of the opposite sides of the first position, wherein the second guide member has a stopper configured to restrict a pivotal movement of the first guide member from the first position to the third position such that the first guide member stops at the third position, a state of the second guide member being changeable between a closed state in which the second guide member defines the at least part of the curved portion and an open state in which the curved portion is exposed, and wherein the third guide member has a guide portion configured to come into contact with the first guide member that is located at the third position and to guide the first guide member to the first position, in a process in which the state of the second guide member changes from the open state to the closed state.

2. The image recording apparatus according to claim 1 wherein the first guide member is constituted by a plurality of guides that are disposed so as to be spaced apart from each other in a width direction orthogonal to the conveyance direction, and wherein the third guide member has a plurality of recessed portions formed so as to be spaced apart from each other in the width direction, each of the plurality of guides of the first guide member located at the first position being fitted in a corresponding one of the plurality of the recessed portions.

* * * * *